United States Patent [19]

Schmechel

[11] Patent Number: 4,951,448

[45] Date of Patent: Aug. 28, 1990

[54] FACILITY FOR THE PRODUCTION OF ROLLS OF COINS

[75] Inventor: Werner Schmechel, Berlin, Fed. Rep. of Germany

[73] Assignee: F. Zimmermann & Co., Berlin, Fed. Rep. of Germany

[21] Appl. No.: 322,762

[22] Filed: Mar. 13, 1989

[30] Foreign Application Priority Data

Mar. 15, 1988 [DE] Fed. Rep. of Germany ..... 3809039

[51] Int. Cl.[5] ..... B65B 11/04

[52] U.S. Cl. ..... 53/532; 53/66; 53/212; 53/542; 53/557

[58] Field of Search ..... 53/532, 212, 542, 557, 53/442, 446, 389, 66, 64, 504, 531

[56] References Cited

U.S. PATENT DOCUMENTS

| | | | |
|---|---|---|---|
| 1,038,361 | 9/1912 | Hart | 53/532 X |
| 3,290,860 | 12/1966 | Rau | 53/532 X |
| 4,391,560 | 7/1983 | Fardin | 53/532 X |
| 4,505,093 | 3/1985 | Johnson | 53/542 X |

FOREIGN PATENT DOCUMENTS

| | | | |
|---|---|---|---|
| 1393308 | 5/1989 | Japan | 53/532 |

*Primary Examiner*—James F. Coan

*Attorney, Agent, or Firm*—McGlew & Tuttle

[57] ABSTRACT

This invention refers to a mechanism for the production of rolls of coins, with a feeding track for horizontal coins. A tilting station is provided to put the coin into an upright position, and a wrapping station is provided to form rolls of coins out of the stacks of vertical coins.

In order to increase the amount of coins to be gathered into stacks of coins and wrapped as rolls of coins, per time unit, and in order to reduce the size of the mechanism the invention provides a tilting station consisting of two parallel tracks which connect to a feeding track. The parallel tracks are spaced a distance from each other which is slightly less than the diameter of the coins. A coin retainer is provided with an angled surface spanning the transportation direction of the coins. The coin retainer is mounted so that it can be swivelled against the transportation direction of the coins.

17 Claims, 11 Drawing Sheets

FACILITY FOR THE PRODUCTION OF ROLLS OF COINS

Field of the Invention

The present invention relates to a mechanism for the production of rolls of coins with a feeding track for horizontal coins, the tilting station to change the horizontal position of the coins to a vertical position and a wrapping station where the stacks of upright coins are transformed to rolls of coins.

BACKGROUND OF THE INVENTION

A facility of this kind is already known from German publication No. 19 46 278. This reference teaches a mechanism in which coins are transported in a horizontal position by a slide to several channels which end in tilting zones. In these zones the channel floor is removed on one side so that the coins tilt to the side and stand on edge. In this position the coins ride on conveyor belts that will transport them in an upright position to a collecting station where the coins are gathered in rolls. In a wrapping station this roll is then wrapped in foil. The disadvantage of this already existing facility is that the coins can only be transported and gathered for wrapping with a relatively low speed. Furthermore, the existing mechanism requires substantial equipment, so that it cannot be used as a tabletop device.

SUMMARY OF THE INVENTION

Therefore, this invention aims at improving the existing mechanism so that a high number of coins per time unit can be gathered and wrapped with little equipment requirements.

The inventive coin roll producing apparatus includes a tilting station consisting of two parallel tracks which connect longitudinally to a feeding track. The distance of the feeding track between the two parallel tracks is slightly less than the diameter of the coins. At least one coin retainer is provided with an angled surface spanning the transportation direction of the coins. The coin retainer is mounted so it can be swivelled against the transportation direction of the coins.

A known coin counting and sorting machine with a horizontal rotary plate transports the coins with a high speed of up to 3000 coins per minute directly into the inventive mechanism and onto the two parallel tracks of the tilting station. Here, the first coin retainer puts the first coin in a tilted position of 45 to 60 degrees, across the transport direction and the tracks. The next and all following coins hit against the lower edge of the first tilted coin so that all following coins are queued up in a leaning position. After a short time there is leaning roll of coins on the tracks of the tilting station which will then be transported to the wrapping station on the same level and wrapped in foil, thermoplastic or the like. This mechanism requires very little space as the machine is not much longer than twice the length of the longest roll of coins to be wrapped. Because of the scaling of the coins on the parallel tracks of the tilting station the coins can be stacked with a speed of up to 3000 coins per minute.

Thus, the distance between the tracks can be adjusted to be symmetrical to the longitudinal axis of a conveyor belt so that the mechanism can be adjusted to accommodate coins of different diameters. Furthermore, a transport slide in connection with a forward coin blocking device is considered. A rear coin blocking device fulfills the retaining function of the transport slide within the wrapping station. In the wrapping station the coins are wrapped in foil thermoplastic or the like to produce the finished rolls. The wrapping station consists of two rubber rollers, a foil dispenser and a foil press as well as hot air jets to shrink the edges of the foil.

German publication No. 12 91 152 teaches a device which uses two parallel tracks to produce stacks of coins which will then be moved by grippers to two wrapping rollers below the tracks where these stacks will be wrapped in paper to create a roll. However, the coins are transported individually and in a position vertical to the stacking tracks so that the mechanism only works with a relatively low speed. Because the stacking tracks are on top of the wrapping rollers, the mechanism requires a lot of space so that it cannot also be used as a tabletop device.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENT

Figure 1:
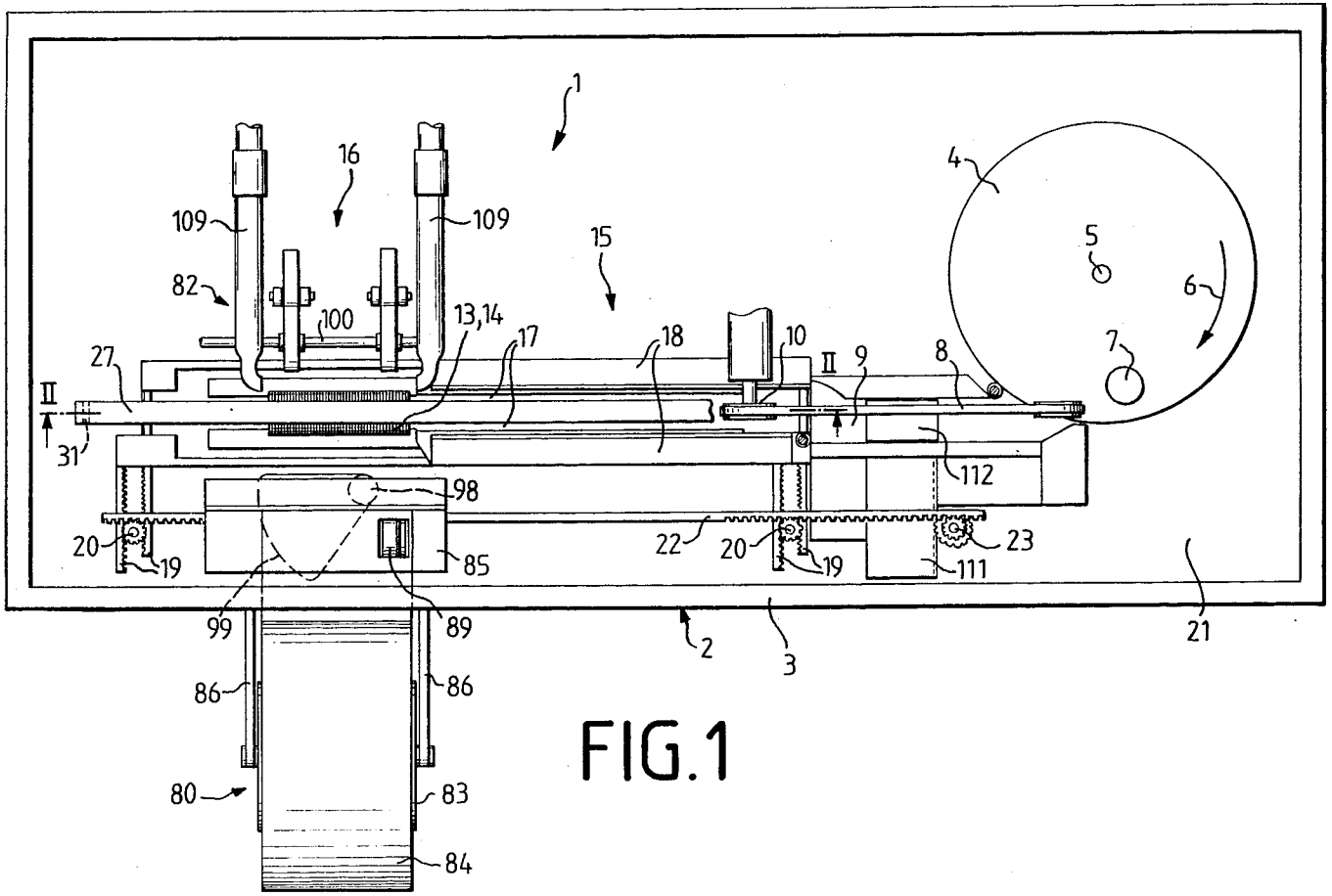
FIG. 1 is a top view of a coin roll producing mechanism according to the invention.

Referring to the drawings, in particular, the invention embodied therein includes a feeding track means 9 for transporting horizontally positioned coins 7 from a first location 4 to a second location, along a feeding track path. Tilting station means 15 is provided positioned adjacent the second location. The tilting station means 15 changes the position of the coin 7 from a horizontal position to a vertical position. The tilting station 15 includes first and second parallel tracks 17 extending in the direction of the feeding path. The first and second tracks 17 are spaced a distance which is less than the diameter of the coins (preferably slightly less). The first and second tracks 17 each have a first end positioned adjacent the second location. The tilting station 15 includes a coin retaining means 32 spanning the transportation direction of the coins adjacent the first and second tracks. The retaining means forms stacks of horizontal coins on the first and second tracks as the coins are fed to the tracks from the feeding track 9. The retaining means 32 includes an angled surface member 35 which is swivably movable against the transportation direction of the coins, such that the coins stack up and progressively are oriented in a vertical manner. The coins stacked in a vertical manner are then moved to a wrapping station 16 to process the stacks 14 of the collected coins.

The mechanism for the production of coin rolls according to the invention is formed as part of a coin counting and sorting mechanism 2. This mechanism 2 includes a casing 3 providing a housing for a horizontal rotating plate 4. The horizontal rotating plate 4 is driven about a vertical axis 5 by a motor, in the rotating direction 6. The coins 7 that are transported to the rotating plate 4 by a slide (not described in detail) are transported tangentially via a conveyor belt 8 from the rotating table 4 to the feeding track 9 which transports the coins 7 to the mechanism 1 for the production of rolls of coins. The feeding track 9 contains counting and sorting mechanisms (not described in detail). A rocker .12 (see FIG. 2) transports all coins 7 to a collecting shaft (not further described) during a counting and sorting process, without the mechanism 1. The rocker 12 is located at the end of feeding track 9 underneath the forward deflector roller 10 for the conveyor belt 8 which rotates in the direction 11. For this purpose the rocker 12 is tilted up. In the normal position, the surface of rocker 12 is on the same level as the feeding track 9 so that all coins 7 are fed into the mechanism 1 for the production of rolls of coins. The rocker 12 will be described in detail at a later stage.

The mechanism 1 for the production of rolls of coins consists of the tilting station 15 which moves the coins 7, which are horizontal on the feeding track 9, into an upright position. A wrapping station 16 processes the stacks 14 of collected pins, in upright position 7, into rolls of coins 13.

The tilting station 15 consists of two parallel tracks 17 which connect longitudinally to the feeding track 9. The tracks 17 are spaced a distance from each other. The distance may be adjusted to be symmetrical to the longitudinal axis of the conveyor belt 8. The adjustment is made by attaching the tracks 17 to track carriers 18 which run the length of the tilting and wrapping station 15, 16. Steering racks 19 are connected at a right angle to both ends of the track carriers 18. Teeth formed on racks 19 are directed against each other and mesh in pairs with pinions 10 which are located with their axis positioned vertically to a cover plate 21 of the counting and sorting machine 2. A long steering rack 22 having engaging teeth or the like is positioned parallel to the feeding track 9 and the tilting and wrapping station 15, 16. The steering rack 22 engages with the pinions 10 and is driven by another pinion 23. An adjusting knob (not shown) attached to pinion 23 is used to adjust the distance between the tracks 17, this distance always being a little less than the diameter of the coins 7. Furthermore, the pinion 23 drives a slide 111 for the adjustment of the width of an exit opening 112. Opening 112 may be set to determine the diameter of the coins 7 to be transported via conveyor belt 9.

A holding down clamp 24 (see FIG. 2) is located above each track 18 and connected with the track carriers 18 via two parallel guide rods 25. The holding down clamps 24 are made of low profile pieces and their vertical height is gradually reduced at their ends which are directed towards feeding track 9. The two holding down clamps 24 are pressed down by a pusher 26 which can be rotated around an axis 28 on an oscillating crank 27 and is pressed by a spring 29 clockwise against the holding down clamps 24. The pusher 26 is located in the middle between the holding down clamps 24 and features two push bolts 30 at its free end which rests on the surfaces of the holding down clamps 24.

The oscillating crank 27 runs the whole length of the tilting and wrapping station 15, 16 and is connected with its oscillating axis 31 to the cover plate 21 of the coin counting and sorting machine 2. In the area of the tilting station 25 the oscillating crank 27 supports four S-shaped coin retainers 32 located between the tracks 17 which are held in the oscillating crank 27 by axles 33 and are under the effect of extension springs 34 which are attached at the upper short end of the coin retainer 32. The extension spring 34 of the first coin retainer 32 in the transport direction is stronger than the extension springs 34 of the following coin retainers 32 The oscillating crank 27 consists of a U-beam in which the axles 33 of the coin retainers 32 are inserted in such a way that their short upper ends with the extension springs 34 attached rest against the upper basis of the U-shaped oscillating crank 37. The S-shaped coin retainers 32 have angular surfaces 35 which are canted against the transport direction of the coins 7. These angular surfaces 35 are made of the short ends of the s-shaped coin retainers 32 which are located opposite the axles 33. The angle of the surfaces 35 for the coins 7 is about 60 degrees.

Figure 2:
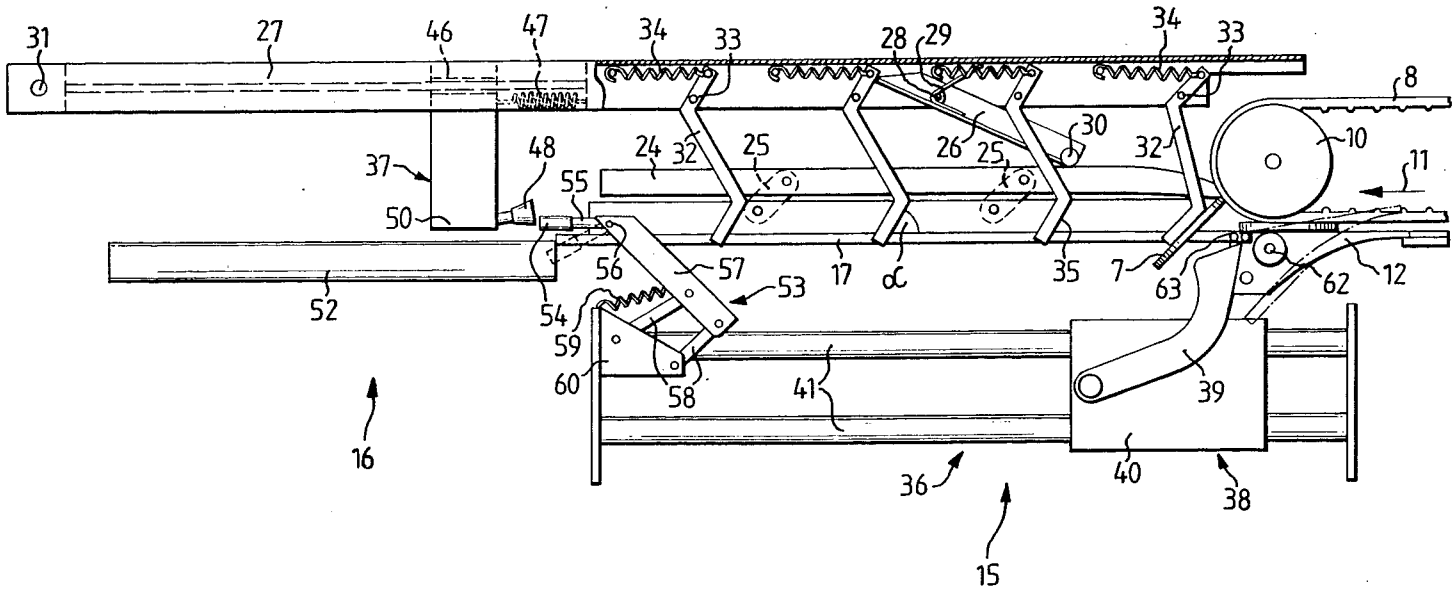
FIG. 2 is a cross sectional view taken in the direction of line II—II in FIG. 1 through a tilting station containing coin.

The tilting station 15 of the mechanism 1 for the production of rolls of coins 13 described above functions as follows:

With the rocker 12 in normal position the coins 7 are transported at high speed from the rotating table 4 via the feeding track 9 to the tilting station 15. Between the rocker 12 the conveyor belt 8 in the area of the forward deflector roller 10 the first coin 7 reaches the area of the tracks 17 whose distance from each other is slightly less than the diameter of the coins 7. Simultaneously the first coin 7 reaches the angled surface 35 of the first coin retainer 32 as shown in FIG. 2. The coin 7 tilts with the lower part of its surface between the tracks 17 without falling all the way through as the surface of the coin 7 rests diagonally against the angled surface 35 of the coin retainer 32. At the same time, the slanted upright coin 7 contacts the lower edges of the 2 coin retainers 24.

Figure 3:
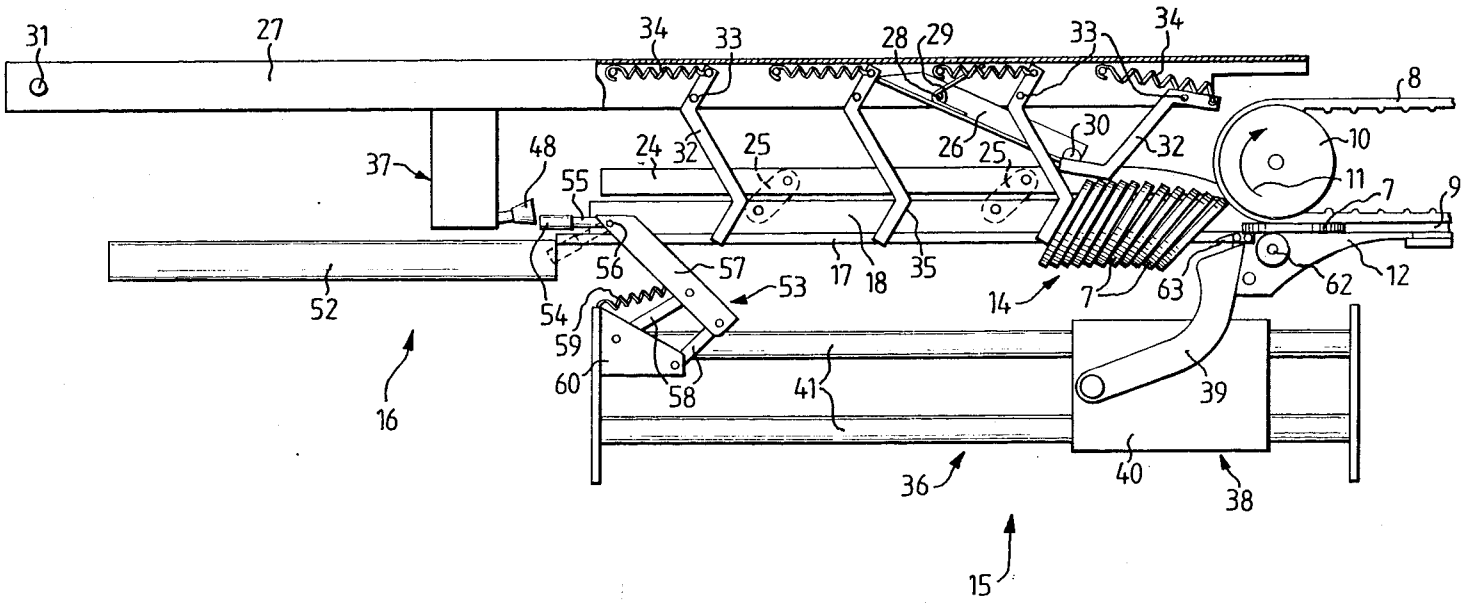
FIG. 3 is a cross sectional view taken in the direction of line II—II as in FIG. 2 through the tilting station containing a stack of eleven coins.

Therefore, the position of the first coin is fixed. Now more coins 7 arrive at a high speed which are positioned against the first coin 7 as shown in FIG. 3 and put in an upright but slanted position. Every following coin 7 pushes the coin already in the tilting station 15 so that the stack of coins 14 which is being made is passed from the first coin retainer 32 on to the second coin retainer 32 as shown in FIG. 3. The angled surface 35 of the first coin retainer 32 rests on the upper side of the coin stack 14 which is being made. This will be continued according to the required size of the coin stack 14 until the required number of coins 7 in the stack 14 is reached. The finished coin stack 14 is passed on to a transport mechanism 36 which transports the coin stack 14 to the wrapping station 16.

Figure 4:
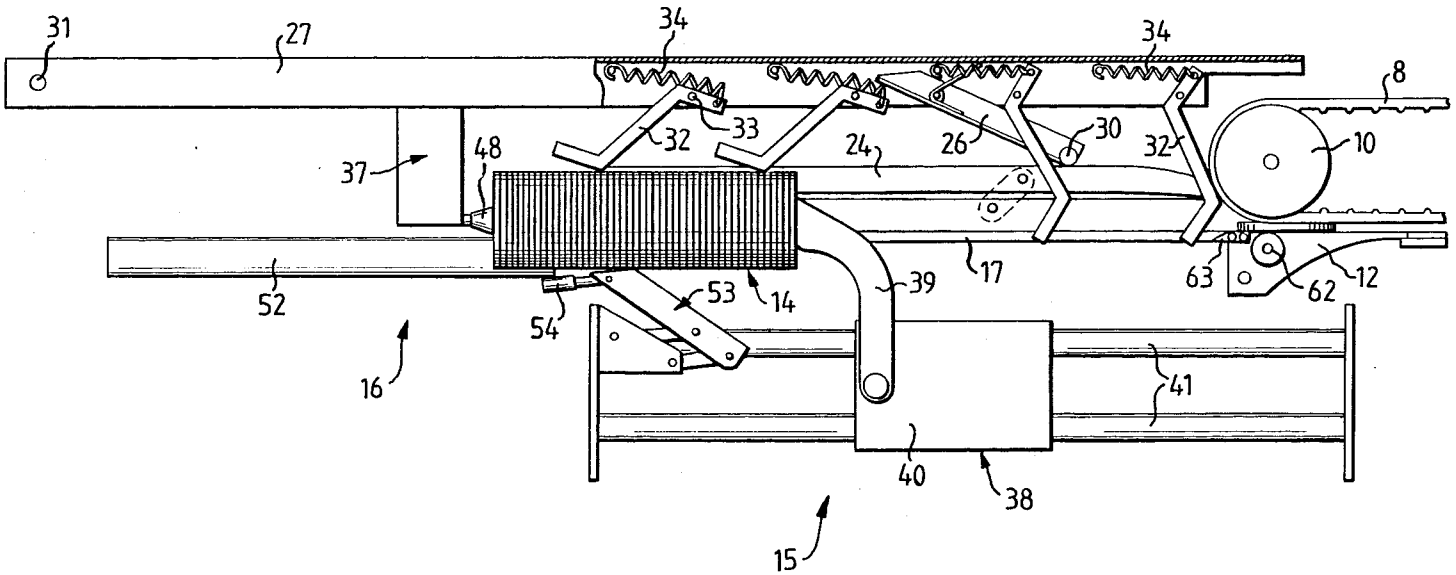
FIG. 4 is a cross sectional view taken in the direction of line II—II as in FIG. 2 through the tilting station, containing a finished stack of coins which is being transported to the wrapping station located on the same level.

The transport mechanism 36 consists of a movable forward coin stack retainer 37 which is located below the oscillating crank 27 and above the tracks 17 and the track support 18 as well as of two slide arms 39 of the transport slide 38 which are located below the tracks 17 and can be moved between them. The slide body 30 of the transport slide 38 rests on two parallel guiding tracks 41 which are attached underneath the cover plate 21 of the coin counting and sorting machine 2. The slide body 40 is moved back and forth on the guiding tracks 41 along a chain 42 by a drive which is not described any further. The transport slide 38 consists of a pair of slide arms 39 which are attached to the slide body 40 with a separator 114 and are parallel with a short distance between them. During a transport movement of the slide body 40 the slide arms 39 are swung automatically along the guiding tracks 41 from the flat position shown in FIG. 6, on the right, to the upright position shown in FIG. 6, on the left. This is achieved by guiding rods 43, 44 which can be operated by a steering rod 45. In the upright position shown in FIG. 6, left, the slide arms 39 are locked in position by the guiding rods 43, 44. As shown in FIG. 4 in this locked position the slide arms 39 push against the last coin of the coin stack 14 on the tracks 17 which is to be moved to the wrapping station.

Figure 5:
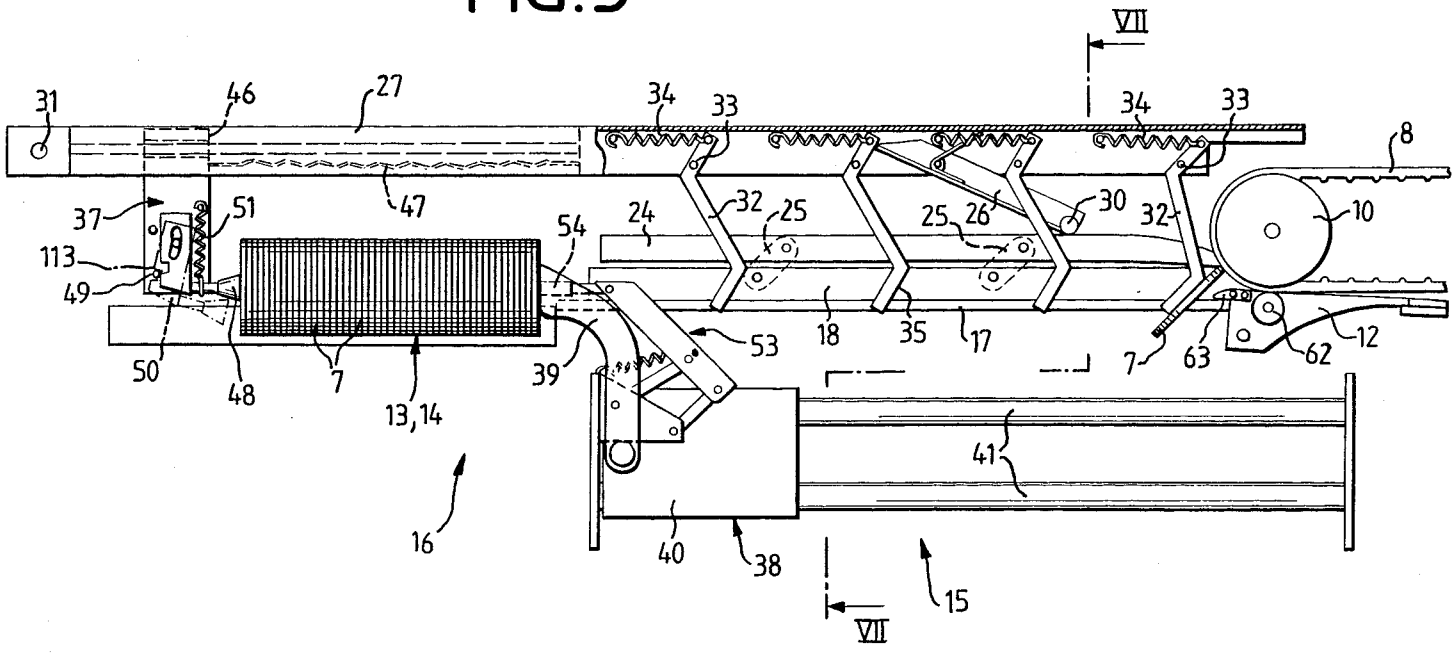
FIG. 5 is a cross sectional view taken in the direction of line II—II as in FIG. 2 through the tilting and wrapping station with a stack of coins in the wrapping station.

The forward coin stack retainer 37 rests on guides 46 below the oscillating crank 27 and is affected by springs 47 which constantly push the forward coin roll retainer 37 in the direction of the tilting station 15. At its lower end the coin roll retainer 37 carries a ram 48 the shaft of which is attached at swing-slide piece 50 which can be rotated under pressure of a spring 51 around the axis 49 which meets a groove 113 and which is axially locked if the pressure is only axial as shown in FIG. 5, left.

Figure 6:
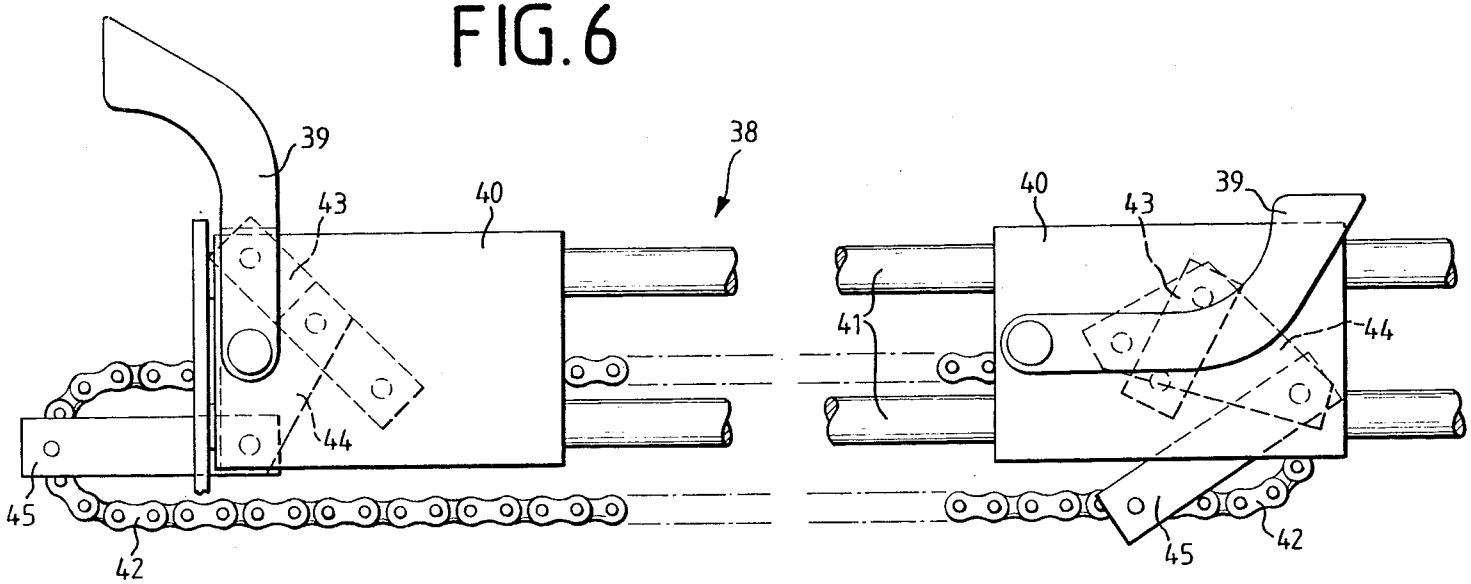
FIG. 6 is an enlarged side view of the transport slide shown in two working positions.
Figure 7:
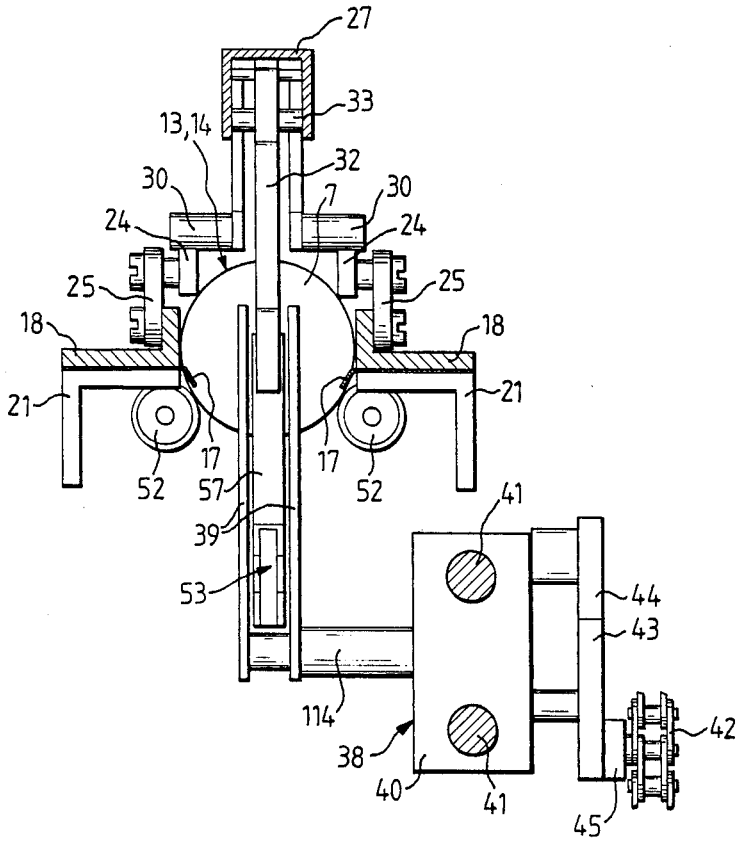
FIG. 7 is a cross sectional view taken in the direction of line VII—VII in FIG. 2 through the tilting station.

During the transport of a coin stack 14 produced in the tilting station 15 into the wrapping station 16 the slide arms 39 of the transport slide 38 are moved upward into the locked position shown in FIG. 6, left. The slide arms 39 now reach behind the last coin 7 of the coin stack 14 and push the whole coin stack 14 towards the wrapping station 16 until the first coin 7 rests against the ram 48 of the forward coin roll retainer 37. All coins 7 are moved into a vertical position and moved as a coin stack 14 via the tracks 17 to the wrapping station 16. The slide arms 39 of the transport slide 38 push the coin stack 14 and the ram 48 against the springs 47 which affect the forward coin roll retainer 37. The ram 48 of the forward coin roll retainer 37 is automatically locked in position.

The wrapping station 26 consists of 2 rubber rollers 52 which receive the coin stack 14 and produce a coin roll 13. These rubber rollers rest on the track supports 18. The distance of the rubber rollers 52 is adjusted just as the distance of the tracks 17 by adjusting the track supports 18.

During the transport of the coin stack 14 from the tilting station 15 to the wrapping station 16 the coin stack 14 pushes down a rear coin roll retainer 53 which is located at the end of the guiding track 41 for the transport slide 38, as shown in FIG. 4. After the coin stack 14 is past retainer 53, the rear coin roll retainer 53 comes back up a shown in FIG. 5. The rear coin roll retainer 53 fits exactly between the two slide arms 39 of the transport slide 38 and its ram 54 touches the center of the last coin 7. The shaft 55 of the ram 54 can be rotated and locked with a spring action at the forward coin roll retainer 37 around a horizontal axis 56 just as the shaft 49 of the ram 48. The rear coin roll retainer 53 consists of a retainer 57 which supports the ram 54 and its shaft 55 as well as two parallel guiding rods 58 which support the retainer arm 57. These guiding rods are attached to the housing of a retainer support 60. An extension spring 59 pushes the retainer arm 57 towards the coin stack 14 located in the wrapping station 16. After the rear coin roll retainer 53 takes the coin stack 14 over, the slide arms 39 of the transport slide arm 38 move back to the initial position shown in FIG. 2 where the slide arms 39 rest below the rocker 12.

Figure 8:
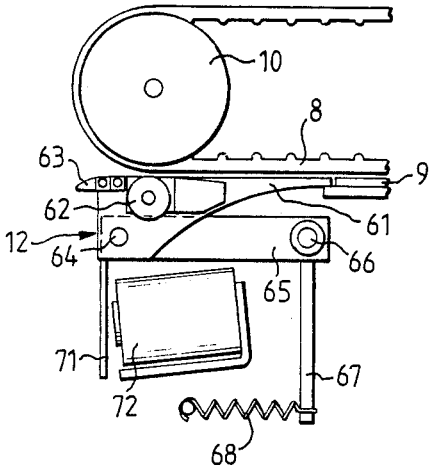
FIG. 8 is a detail view of a bridge-like rocker positioned between a feeding belt and a tilting station.
Figure 10:
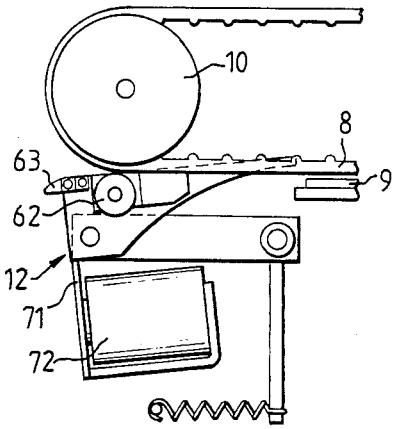
FIG. 10 is a view similar to FIG. 8 with rocker tilted up.
Figure 9:
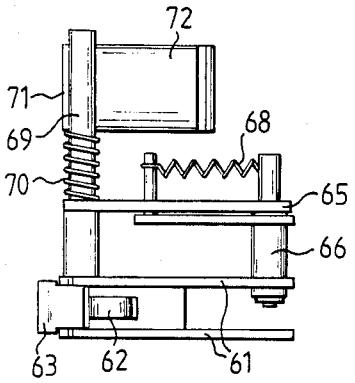
FIG. 9 is a top view of the rocker.

The rocker 12 which is shown in detail in FIGS. 8 through 10 consists of a bridge-shaped guiding track piece 61 the surface of which is level with the surface of the feeding track 9 when the rocker 12 is in its normal position. The bridge-shaped guiding track piece 61 consists of two plate shaped components the distance of which is smaller than the diameter of the smallest coin 7. The bridge-shaped guiding track piece 61 rests in a ball bearing 62 below the deflector roller 10. The ball bearing 62 is about 0.2 mm higher than the surface of the guiding track piece 61 and is supported to facilitate the transport of the coins 7 to the tilting station 16. A swing piece 63 is inserted into the front end of the guiding track piece 61. The swing-piece 53 both helps support the coins 7 to the tilting station 15 and assists the upward movement of the slide arms 39 of the transport slide 38. The guiding track piece 61 rests with a swing axle 64 on a support arm 65 which is attached to an axis 66 mounted to the casing. A pin 67 sits vertically on the support arm 65 which is affected by an extension spring 68 which is supported by the casing. Therefore, the rocker 12 consisting of the guiding track piece 61 and the support arm 65 can be swivelled against the effect of the extension spring 68 around the axis 66 so that the distance between the conveyor belt 8 below the forward deflection roller 10 and the rocker 12 can be adjusted automatically to the different diameters of the coin 7. The swing axle 64 of the guiding track piece 61 consists of a rod 69 with a torque spring 70 wrapped around it. This torque spring 70 is supported by the support arm 65 and has the effect that the guiding track piece 61 is pushed toward its normal position where it is on the same level as the feeding track 9 (FIG. 8). A plate 71 is located opposite a solenoid 72 which is attached to the rod 69. If the solenoid is activated, the plate 71 is retracted so that the guiding track piece 61 is swivelled against the effect of the extension spring 70 in order to interrupt the feeding track 9, in other words the rocker 12 moves up (FIG. 10) so that the coins transported by feeding track 9 are sorted out. Therefore the rocker 12 has a double function. On the other hand, the rocker 12 adjusts for different coin thicknesses and on the other hand the rocker 12 sorts out coins which are not to be transported to the mechanism 1 for the production of coin rolls.

The wrapping station 16 (FIGS. 11 to 15) consists of the rubber rollers 52 attached to the track supports 18 whose distance from each other is less than the diameter of the coins 7 and at least one of which can be driven and also comprises of a foil dispenser 80 on one longitudinal side to feed wrapping foil 81 and on the other longitudinal side of the rubber rollers 52 of a pressure mechanism 82 for the foil 81 in order to wrap the foil around the coin stack 14 and produce a coin roll 13.

Figure 13:
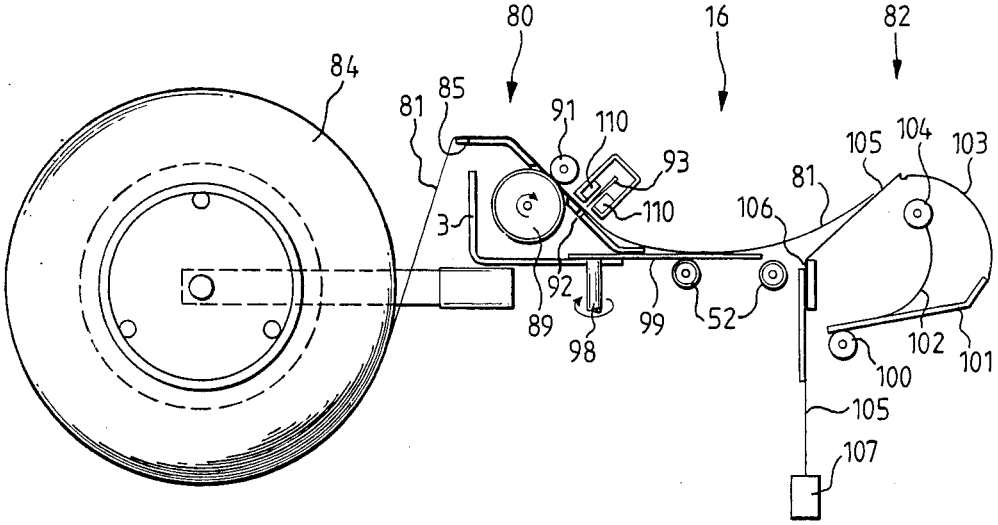
FIG. 13 is a simplified cross sectional view through the wrapping station with foil in place
Figure 14:
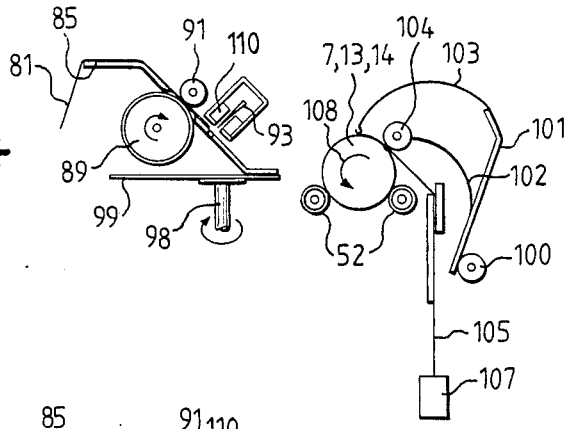
FIG. 14 is a cross sectional view similar to FIG. 13 after a stack of coins has been inserted.
Figure 15:
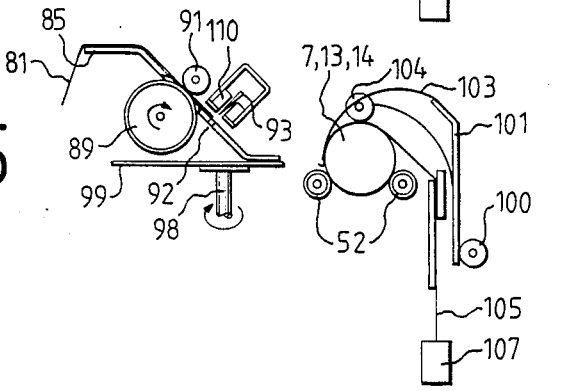
FIG. 15 is a cross sectional view similar to FIG. 13 after completion of a roll of coins; and, FIG. 16 is an enlarged cross sectional view through the foil dispenser.

The foil dispenser 80 comprises a receptacle 82 for a roll of foil 84 as well as a measuring and feeding table 85 to feed the foil 81. The receptacle 83 for the roll of foil 84 comprises two receiving arms 86 jutting out of the casing 3 of the coin counting and sorting machine 2. The roll of foil 84 is mounted between receiving arms 86, the receiving arm shown on the left in FIG. 1 being attached in the casing 3 in a way so that it can be adjusted to foils of different widths. A drive motor 87 is flange mounted to a casing supported bracket 88 below the feeding table 85 for the foil 81. This motor 87 has a fly wheel 89 which reaches through the opening 90 on one side of the feeding table 85 in order to transport the foil 81 which is flat on the feeding table 85. In order to achieve a forward movement the fly wheel 89 is connected to a pressure roller 91 above the feeding table 85 (FIG. 13 through 15). In the transport direction of the foil 81 the feeding table 85 is cut by a slit 92 on the other side of which a knife 93 is located which is shown in detail in FIG. 16. Another roller 94 reaches through the opening 90 in the feeding table 85. This roller 94 has an axis concentric to the axis of the roller 89 to drive the foil 81 which is over-mounted on the axis 95 of a dispenser 96 which is attached by a casing supported bracket 97. The dispenser 96 measures and monitors the length of a piece of foil 81 required to wrap a stack of coins 14.

A segment piece 99 which can be swivelled around a vertical axis 98 transports the foil 81 from the feeding table 85 to the rubber rollers 52. This segment piece 99 is swivelled across the two rubber rollers 52 as shown in FIG. 13 from the position underneath the feeding table 85 for the foil 81 shown in FIG. 11 in order to transport the foil 81 across the two rubber roller 52 to the pressure device 82 situated on the side of the rubber rollers 52 across from the foil dispenser 80.

The pressure device 82 for the foil 81 consists of two rigid brackets 101 which can be swivelled around an axis 100. A shorter spring steel band 102 is attached to the middle of the brackets 101 and a longer spring steel band 103 is attached to the end. The shorter spring steel band 102 has a pressure roller 104 with a free wheel. The longer spring steel band 103 is connected at the end with an elastic band 105 which is deflected downwards at position 106 at the nearest rubber roller 52 and has a weight 107 attached to its end.

The described wrapping station 106 functions as follows:

The foil 81 is rolled of the roll of foil 84 situated in the receiving arm 86 and transported, across the feeding table 85 with a slanted surface, to the slit between the transport roller 9 and the pressure roller 91. The dispenser 96 is set to zero. Then the required length is transported by the transport roller 89 with counter pressure from the pressure roller 91 and with segment piece 99 extended across the two parallel rubber rollers 52 into the area of the pressure device 82 as shown in FIG. 13. As soon as the measuring roller of the dispenser determines the required length the transport roller 89 is stopped. The foil is then cut with the knife 93. Now the stack of coins produced in the tilting station 15 can enter the wrapping station 16. During this process the ram 54 of the rear coin roll retainer 53 pulls the foils 81 down as shown in FIG. 4 so that the stack of coins 14 can be pushed onto the rubber rollers 52 of the wrapping station 16 without also transporting the foil 81. After feeding the stack of coins 14 the two brackets 101 of the pressure device 82 swivel against the stack of coins 14 on the rubber rollers 52 thereby pushing the elastic band 105 and the pressure rollers 104 against the stack of coins 14.

The rotating drive of one of the two rubber rollers 52 rotates the stack of coins 14 in the direction of the arrow 108 (FIG. 14) while simultaneously moving the brackets 101 and therefore also the elastic bands 105 as well as the pressure roller 104 as shown in FIG. 15. The elastic band 105 is always under the effect of the weight 107. As soon as the stack of coins 14 is completely wrapped in the piece of foil 81 the hot air jets 109 (FIGS. 1 and 11) are activated which fold the extra foil 81 at the ends of the stack of coins 14 with forced heat against the stack of coins 14. The roll of coins 13 is now finished and can be released downwards by moving the two rubber rollers 52 apart. For this function the rubber rollers 52 are mounted with separate swivel bearings (not further described) to the track supports 18.

Figure 11:
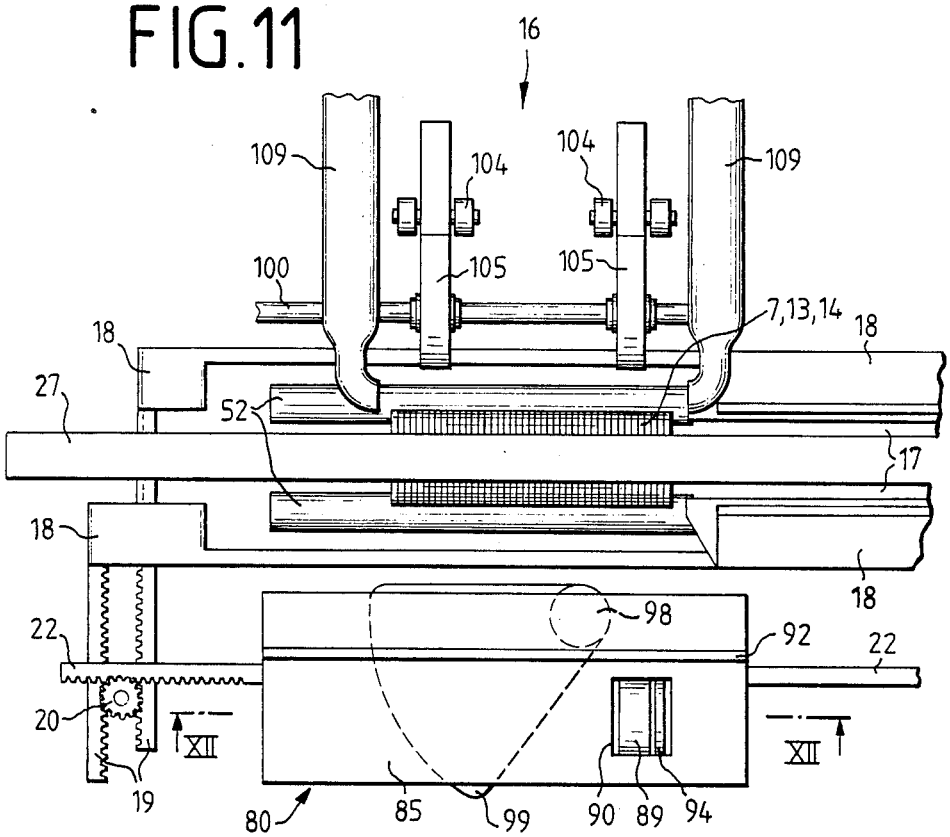
FIG. 11 is a top view of a wrapping station.
Figure 12:
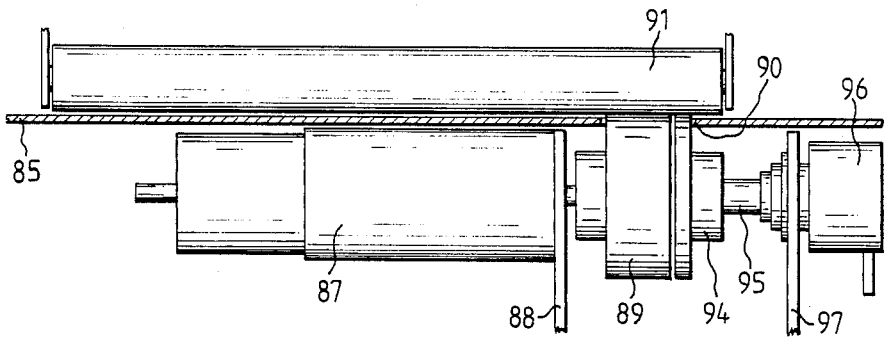
FIG. 12 is a cross sectional view taken in the direction of line XII—XII in FIG. 11 through the feeding table of the wrapping station.

In order to adjust to the length of a roll of coins 13 the receiving arm 86 shown in FIGS. 1 and 11 on the left for the roll of foil 84 as well as the bracket 101 shown on the left and the hot air jet 109 shown on the left are flexibly mounted to the casing 3 of the coin counting and sorting mechanism 2.

Figure 16:
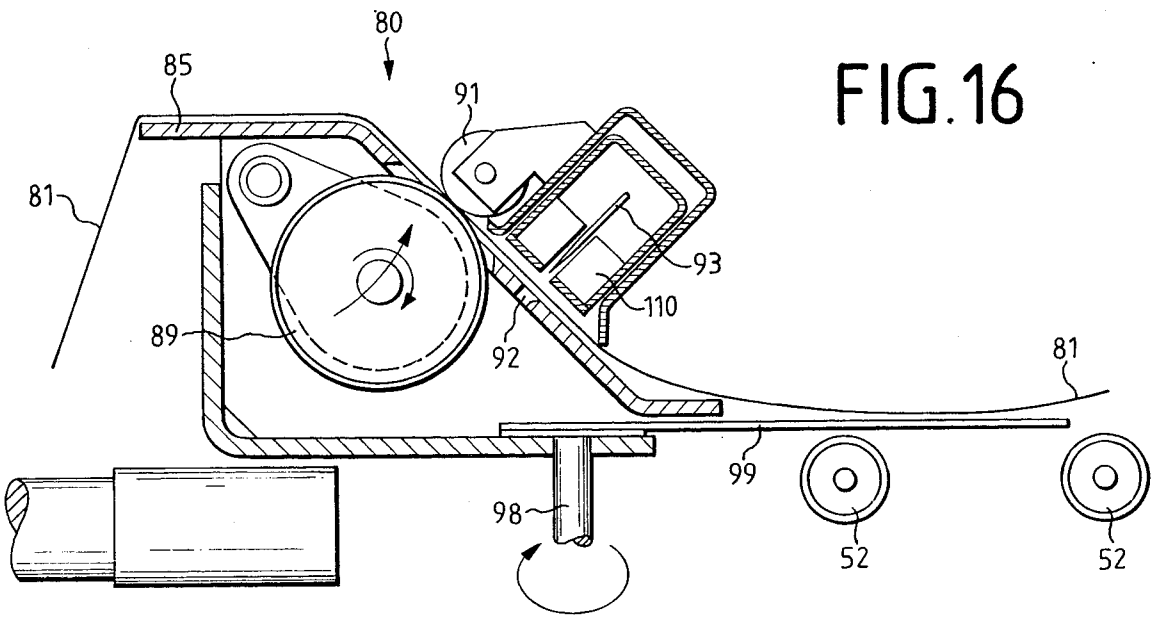

FIG. 16 shows the special shape of the feeding table 85 as in the area where the knife 93 meets the slit 92. Clamping jaw 110 are located on both sides of the knife 92 which are mechanically pushed downwards against the surface of the feeding table 85. The foil 81 is stretched between the clamping jaws 110 so that it can be cut by the knife 93 with the saw-toothed blade. The separation is a combination of perforation and cut. Because of the perforation by the teeth of the knife 93 blade the edges of the foil 81 are ragged which facilitates tearing the foil 81 off the roll of coins 13.

None of the functions of the described mechanism for the production of rolls of coins 13 require a lot of force and energy. The coins 7 slide on the tracks 17 and slide on the rubber rollers 52 without the weight of the coins putting a load on the drive. The stack of coins 14 produced in the tilting station 15 is transported to the wrapping station 16 only through the drive of the transportation device 38 while the stack of coins 14 is held first between the transport arm 39 and the forward coin roll retainer 37 and then between the retainer 37 and the rear coin roll retainer 53 with rams 48, 54 which hold the coins 7. After finishing the roll of coins 13 and removing the rubber rollers 52 the rams 48, 54 tilt downwards after their axial lock is inactivated.

While specific embodiments of the invention have been shown and described in detail to illustrate the application of the principles of the invention, it will be understood that the invention may be embodied otherwise without departing from such principles.

What is claimed is:

1. A coin stacking and rolling arrangement comprising:

feeding track means for transporting horizontally positioned coins from a first location to a second location, along a feeding track path in a transportation direction;

tilting station means for changing the horizontal position of the coins to a vertical position, said tilting station means including first and second parallel tracks extending in the transportation direction, said first and second tracks being spaced a distance which is less than the diameter of the coins, by said first and second tracks each having a first end positioned adjacent said second location and coin retaining means spanning the transportation direction of the coins adjacent said first and second tracks for forming stacks of vertical coins on said first and second tracks, said retaining means including an angled surface member swivably movable against the transportation direction of the coins;

wrapping station means for wrapping stacks of vertical coins to produce rolls of coins 2. A coin stacking and rolling arrangement, according to claim 1, further comprising: spacing means for moving said first and second tracks relative to each other to alter the distance said first and second tracks are spaced from one another, said movement being symmetrical with respect to a central axis along said feeding track path.

3. A coin stacking and rolling arrangement according to claim 1, wherein: said retaining means includes -a plurality of angled surface members, each swivably movable against the transportation direction of the coins, each of said angled surface members being spaced a distance from one another and being connected to an oscillating crank mounted above said first and second tracks.

4. A coin stacking and rolling arrangement according to claim 3, wherein each of said angled surface members form a part of respective S-shaped coin-retaining members.

5. A coin stacking and rolling arrangement according to claim 1, further comprising first and second holding-down clamp members, each of said first and second holding-down clamp members being positioned over a corresponding first and second track and each of said first and second holding down clamp members being connected to an associated track by parallel steering rods.

6. A coin stacking and rolling arrangement according to claim 5, wherein: said holding down clamp members are connected to a pusher member, said pusher member being biased downwardly against said holding-down clamp members by a spring, said spring being mounted flexibly to an oscillating crank mounted above said first and second tracks 7. A coin stacking and rolling arrangement according to claim 1, wherein said tilting station means and said wrapping station means are located on a single level.

8. A coin stacking and rolling arrangement according to claim 7, further comprising: transport slide means mounted below said tracks, said transport slide means including a transport slide member having an end swivable between said first and second tracks, said transport slide means for moving stacks of horizontal coins from said tilting station means to said wrapping station means, said transport slide means including a forward coin roll retainer, said transport slide member and said forward coin retainer engaging a first end of a stack and a second end of a stack respectively to move a coin stack in the transport direction to the wrapping station.

9. A coin stacking and rolling arrangement, according to claim 8, wherein said swivelling transport slide includes a pair of slide arms and a rear coin roll retainer, said rear coin roll retainer supporting a stack of coins at the end of a transport path of said transport slide means.

10. A coin stacking and rolling arrangement, according to claim 9, wherein said rear coin roll retainer and said forward coin roll retainer each include ram elements to engage the stack of coins, the ram elements each having shafts about which said ram elements may be swivelled and locked by means of forward and rear coin roll retainer spring elements.

11. A coin stacking and rolling arrangement according to claim 1, wherein said wrapping station includes a first rubber roller and a second rubber roller having central axes extending in said transportation direction, at least one of said first and second rubber rollers being driven, said first and second rubber rollers being spaced a distance which is less than the diameter of the coins, a foil dispenser for feeding foil and a pressure device for pressing the foil against a stack of coins.

12. A coin stacking and rolling arrangement according to claim 11, wherein said foil dispenser includes a foil receptacle for receiving the foil, a feeding table including a transport and measuring roller, a substantially unloaded pressure roller and a knife for cutting a required length of foil.

13. A coin stacking and rolling arrangement according to claim 11, wherein said pressure device includes a first rigid bracket swivable about an axis, a spring steel band attached adjacent the center of said axis, a second steel band having a length longer than said first steel band being attached to the end of said spring steel band, said spring steel band carrying a pressure roller rotatable at an idling speed, said second spring steel band carrying an elastic band at an end, said elastic band being deflected adjacent one of the first and second rubber rollers, said elastic band having an end connected to a weight.

14. A coin stacking and rolling arrangement, according to claim 11, wherein said distance between said first and second rubber rollers is adjustable according to the diameter of the coins, said foil dispenser having a foil receptacle of adjustable width, the pressure device having rigid brackets which may be adjusted according to the length of the roll of coins to be produced.

15. A coin stacking and rolling arrangement according to claim 11, wherein said wrapping station means includes first and second hot air jets to shrink edges of said foil after said foil is wrapped around edges of the first and last coin of the stack of coins, the distance between first and second hot air jets being adjustable in accordance with the length of the coin stack.

16. A coin stacking and rolling arrangement according to claim 12, wherein: said feeding table forms a slit, said knife being extendable into said slit, said foil being retained adjacent said slit by clamping jaws at the feeding table.

17. A coin stacking and rolling arrangement according to claim 16, wherein said knife has a sawtooth blade.

* * * * *